US012369715B2

(12) United States Patent
Hung

(10) Patent No.: US 12,369,715 B2
(45) Date of Patent: Jul. 29, 2025

(54) STACKING STOOLS

(71) Applicant: Yvonne Hung, San Francisco, CA (US)

(72) Inventor: Yvonne Hung, San Francisco, CA (US)

( * ) Notice: Subject to any disclaimer, the term of this patent is extended or adjusted under 35 U.S.C. 154(b) by 202 days.

(21) Appl. No.: 18/209,709

(22) Filed: Jun. 14, 2023

(65) Prior Publication Data

US 2023/0404264 A1 Dec. 21, 2023

Related U.S. Application Data

(60) Provisional application No. 63/352,555, filed on Jun. 15, 2022.

(51) Int. Cl.
*A47C 3/04* (2006.01)
*A47B 85/04* (2006.01)

(52) U.S. Cl.
CPC ..... *A47C 3/04* (2013.01); *A47B 85/04* (2013.01)

(58) Field of Classification Search
CPC ..... A47C 3/04; A47B 85/04
See application file for complete search history.

(56) References Cited

U.S. PATENT DOCUMENTS 2,509,525 A * 5/1950 Reichhelm ..... A47C 3/16 297/239
3,057,661 A * 10/1962 Moxley ..... A47C 7/42 297/239
3,205,839 A * 9/1965 Norreklit ..... A47B 7/02 297/239
3,347,186 A * 10/1967 Khattar ..... A47C 3/04 5/8
4,779,541 A * 10/1988 Milward ..... A47B 7/02 108/91
5,632,524 A * 5/1997 Ikeda ..... A47C 3/04 297/239
10,779,654 B2 * 9/2020 Kim ..... A47C 9/00
2002/0153754 A1 * 10/2002 Huang ..... A47C 12/02 297/239

FOREIGN PATENT DOCUMENTS

FR 2661813 A1 11/1991

OTHER PUBLICATIONS

International Search Report and Written Opinion issued on Oct. 16, 2023 in corresponding International Application No. PCT/US2023/025466; 7 pages.

* cited by examiner

*Primary Examiner* — David R Dunn
*Assistant Examiner* — Christopher E Veraa
(74) *Attorney, Agent, or Firm* — Plager Schack LLP; Mark H. Plager; Kara K. Verryt

(57) ABSTRACT

A piece of furniture that includes a plurality of stools that stack/nest into an enclosed table may include a top stool, a first middle stool, a second middle stool, and a bottom stool. The top stool and the bottom stool may each include a platform and legs extending downward from a bottom surface of the platform proximate to an outer edge of the platform. The first middle stool and the second middle stool may each include a platform and legs extending from an outer circumference of the platform. The middle stools may each be shorter than the top stool and the bottom stool by a distance equal to a height of the platform, such that they are configured to nest within the space created by the mating of the top stool and an inverted bottom stool.

9 Claims, 4 Drawing Sheets

STACKING STOOLS

RELATED APPLICATION

This application claims priority to provisional patent application U.S. Ser. No. 63/352,555 filed on Jun. 15, 2022, the entire contents of which is herein incorporated by reference.

BACKGROUND

The embodiments described herein relate generally to furniture and, more particularly, to a set of stacking stools that nest into a single stool or side table.

Typically, when stacking stools one on top of the other, the stack increases in height with each stool. In the context of apartment living, it is neither spatially nor aesthetically optimal to have a stack of stools for extra seating. Furthermore, it is generally unsafe to sit on top of a stack of conventional stools, as the stools are not locking into the previous or subsequent stool.

Therefore, what is needed is a plurality of stools that stack together to form a concealed table or stool, wherein the stack may be safely used as such table or stool.

SUMMARY

Some embodiments of the present disclosure include a piece of furniture that includes a plurality of stools that stack/nest into an enclosed table. The piece of furniture may include a top stool, a first middle stool, a second middle stool, and a bottom stool. The top stool and the bottom stool may each include a platform and legs extending downward from a bottom surface of the platform proximate to an outer edge of the platform. The first middle stool and the second middle stool may each include a platform and legs extending from an outer circumference of the platform. The middle stools may each be shorter than the top stool and the bottom stool by a distance equal to a height of the platform, such that they are configured to nest within the space created by the mating of the top stool and an inverted bottom stool.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as stools and/or a side table and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-7, some embodiments of the present disclosure include a piece of furniture comprising a plurality of stools that stack/nest together to form an enclosed table. Specifically, the piece of furniture comprises a top most stool, a top middle stool, a bottom middle stool, and a bottom most stool that nest together to form the stacked table. The top most stool and the bottom most stool may have the same structure, and the top middle stool and the bottom middle stool may have the same structure. As shown in the Figures, each stool may include a platform and a plurality of legs extending substantially perpendicularly therefrom.

Figure 3:
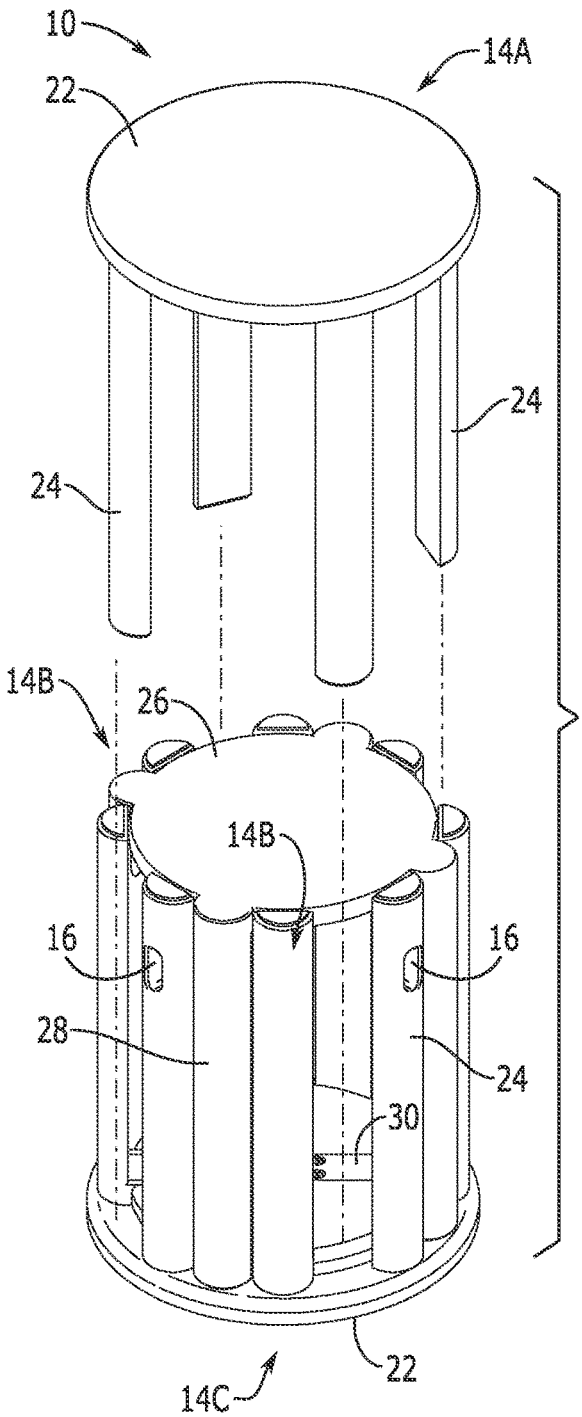
FIG. 3 is a partially exploded perspective view of one embodiment of the present disclosure.
Figure 4:
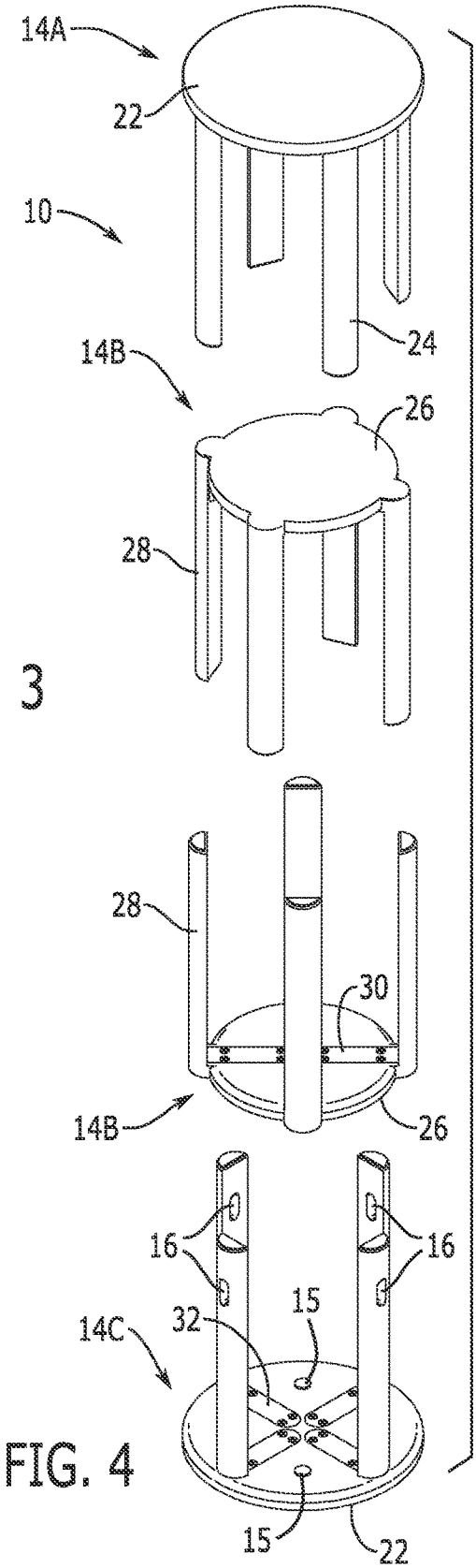
FIG. 4 is an exploded perspective view of one embodiment of the present disclosure.

More specifically, and as shown in FIGS. 1-5, a first embodiment of the piece of furniture 10 may comprise a top most stool 14A, a plurality of middle stools 14B comprising at least a top middle stool and a bottom middle stool, and a bottom most stool 14C that nest together to form a stacked configuration 12 resembling a table. The top most stool 14A and the bottom most stool 14C may have substantially the same structure, wherein the top most stool 14A and the bottom most stool 14C each comprise an outer stool platform 22 with a plurality of outer stool legs 24 extending downward from an outer edge of a bottom surface of the outer stool platform 22. In other words, the outer stool legs 24 may be attached to and extend downward from a bottom surface of the outer stool platform 22. In some embodiments, and as shown in FIG. 4, the outer stool legs 24 may be attached to the bottom surface of the outer stool platform 22 using, for example, a bracket 30. However, in other embodiments, different fastening means may be used. In fact, in a particular embodiment, the outer stool platform 22 may be formed with the outer stool legs 24 as a single piece using, for example, injection molding.

Figure 5:
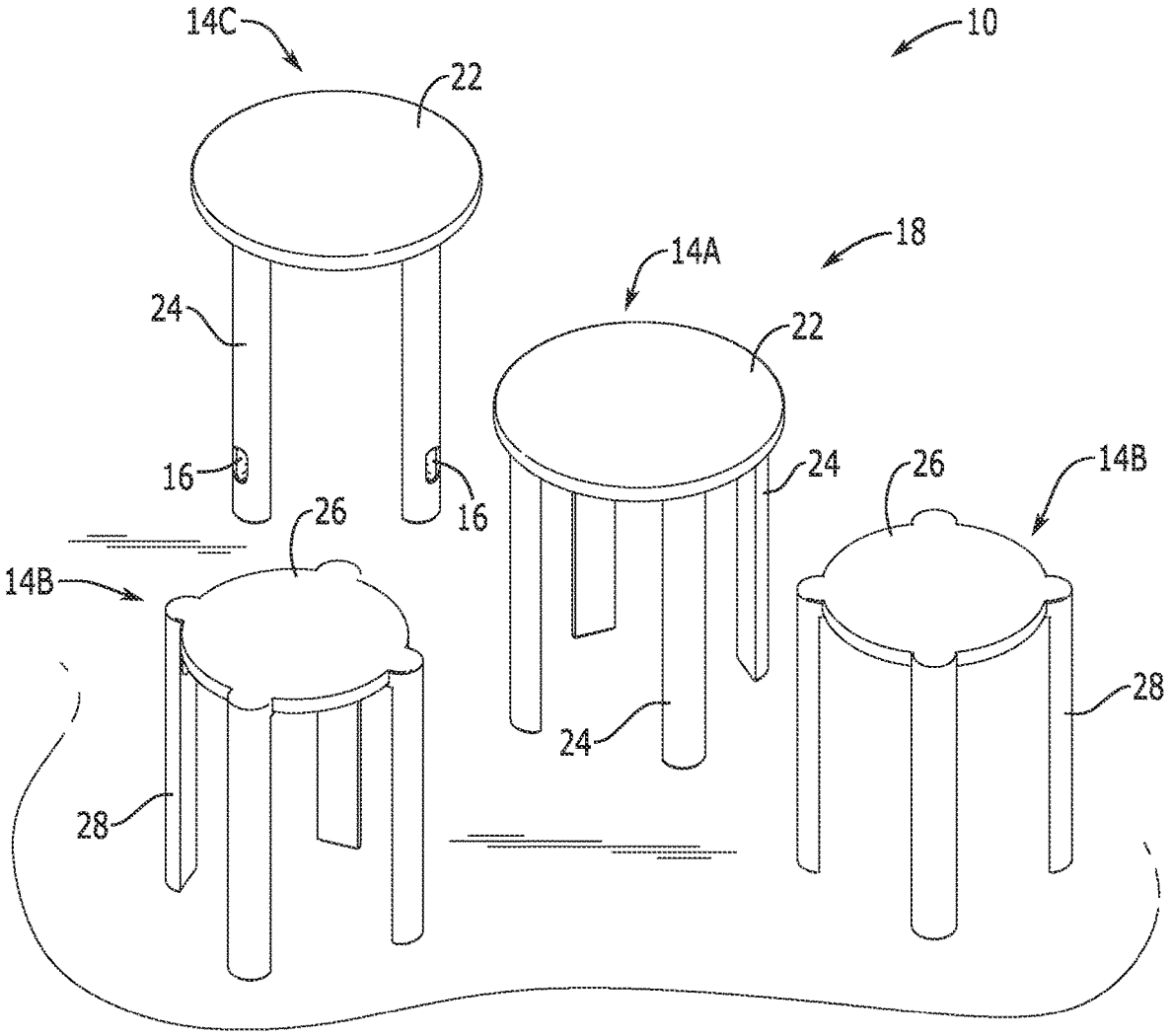
FIG. 5 is a perspective view of one embodiment of the present disclosure, showing the stools in the unstacked configuration 18.

As mentioned above and as shown in the Figures, the plurality of middle stools 14B may comprise at least a top middle stool and a bottom middle stool, wherein each stool of the plurality of middle stools 14B may have the same structure. More specifically, each stool of the plurality of middle stools 14B may comprise a middle stool platform 26 and a plurality of middle stool legs 28 extending therefrom. As shown in FIGS. 4 and 5, the plurality of middle stool legs 28 may each be attached to and extend downward from an outer circumference of the middle stool platform 26. The middle stool legs 28 may be attached to the middle stool platform 26 using any known fastening means and, in some embodiments, are attached using a brace 32. In other embodiments, the middle stool legs 28 and the middle stool platform 26 may be formed together into a single piece using, for example, injection molding.

Figure 1:
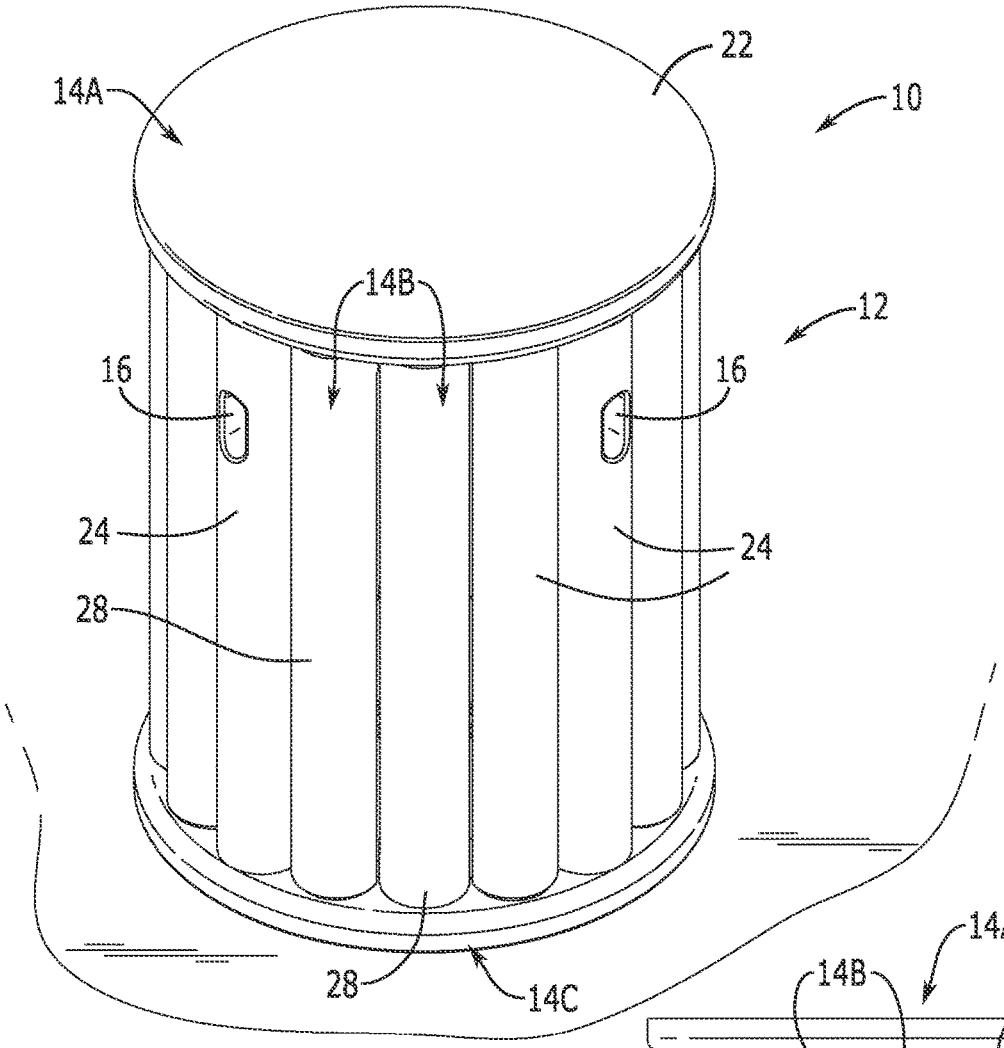
FIG. 1 is a front perspective view of one embodiment of the present disclosure, showing the stools in the stacked configuration 12.
Figure 2:
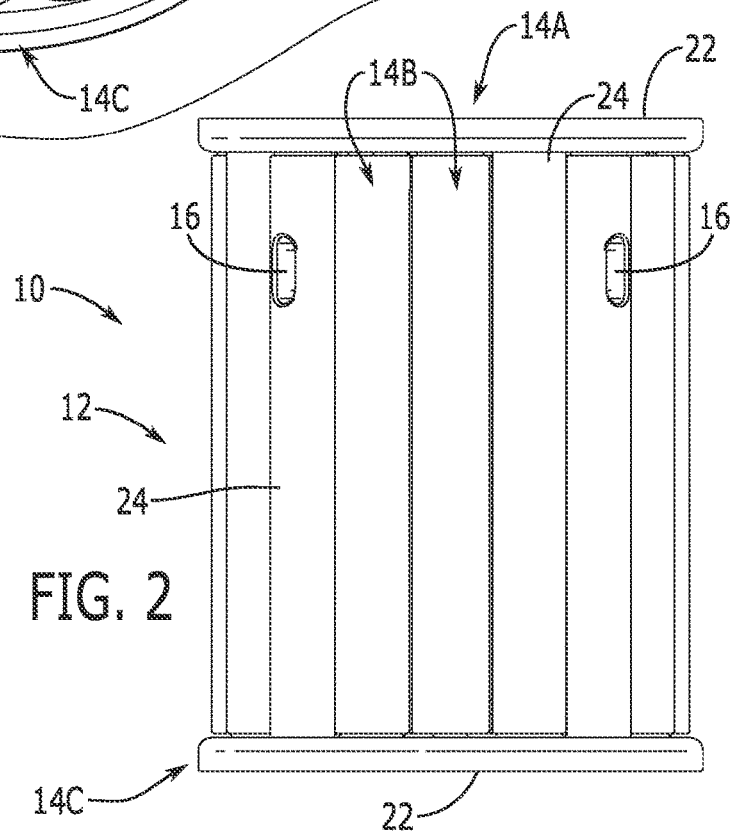
FIG. 2 is a side elevation view of one embodiment of the present disclosure, showing the stools in the stacked configuration 12.

While the structure of all of the stools is similar, as shown in FIG. 5, the middle stools 14B may be slightly shorter than the top most stool 14A and the bottom most stool 14C. Specifically the difference in height may be substantially equal to a height of a platform, while the length of all of the legs may be substantially equal. The discrepancy in height allows the middle stools 14B to nest within the top most stool 14A and the bottom most stool 14C when stacked, as shown in FIG. 3. To create the stacked configuration 12, the bottom most stool 14C may be inverted such that the plurality of bottom legs extend upward from the bottom platform. A first of the middle stools 14B may also be inverted and nested between the bottom legs. A second of the middle stools may be positioned such that its middle legs are surrounding the first middle stool platform, and the top stool 12A may be placed on top of the three already stacked stools, as shown in FIG. 3, forming an enclosed table. When stacked, the vertical edge of the middle stool platforms 26 may fit within the legs of the top most stool 14A and the bottom most stool 14C, while the top surface of the middle stool platform 26 may abut the bottom surface of either the top platform or the bottom platform. In some embodiments, the bottom surface of both of the outer stool platforms 22 may include an optional glide or pad 15 attached thereto, wherein the glide or pad 15 may help prevent damage or scratches to a top surface of the middle stool platform 26. Because each of the middle stools 14B are shorter than the top most stool 14A and the bottom most stool 14C but a distance equal to a height of the platform (including any padding) and because the circumference of the middle platform is smaller than the top platform, the middle stool 14B may fit completely under the top stool 14A. However, because of the difference in top profile, the middle stool legs 28 may be the same distance from the center as the outer stool legs 24. Thus, when the stools are stacked, the middle stool legs 28 and the outer stool legs 24 may align, as shown in FIG. 1.

As shown in the Figures, in some embodiments, at least some of the legs may comprise an orifice 16 extending therethrough, wherein the orifice 16 may be used as a handle. In a particular embodiment, at least one leg on the bottom most stool 14C may have the orifice 16 extending therethrough, such that a user can carry the entire stack of stool.

As shown in the FIGS. 1-5, the outer stool platforms 22 may be substantially circular and the inner stool platforms 26 may be substantially circular with semicircular protrusions that define a top edge of the middle stool legs 28. The legs may be elongate with a semicircular outer surface. As a result, when the stools are stacked, the stacked configuration 12 may have a substantially cylindrical shape. However, the stools and the legs are not limited to such shape.

Figure 6:
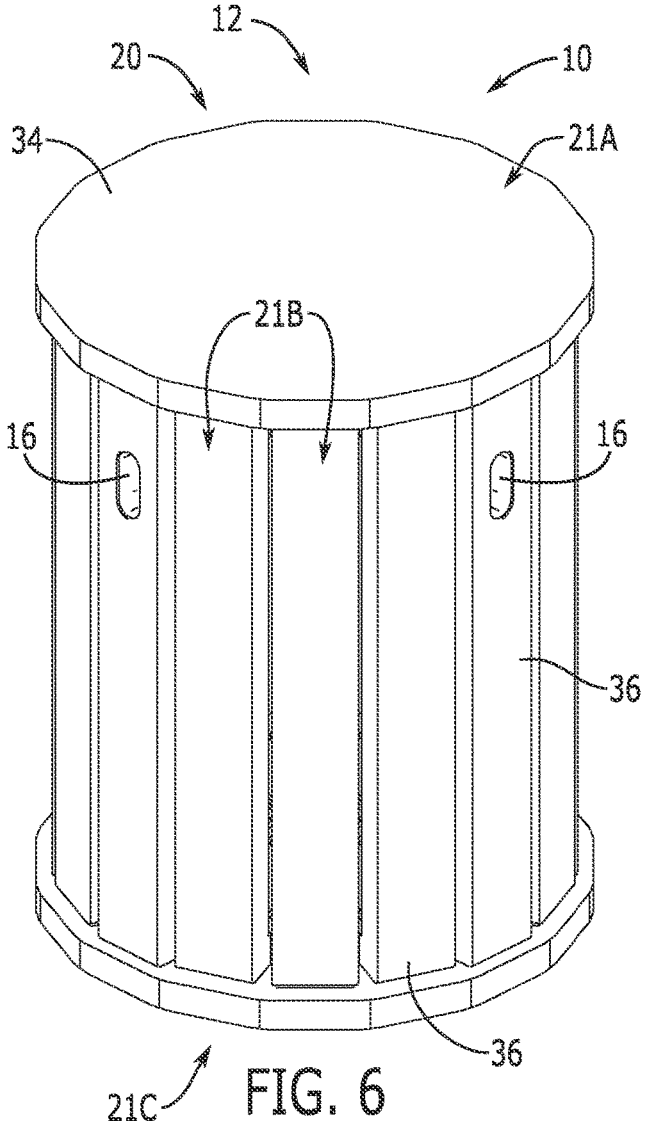
FIG. 6 is a perspective view of one embodiment of the present disclosure.
Figure 7:
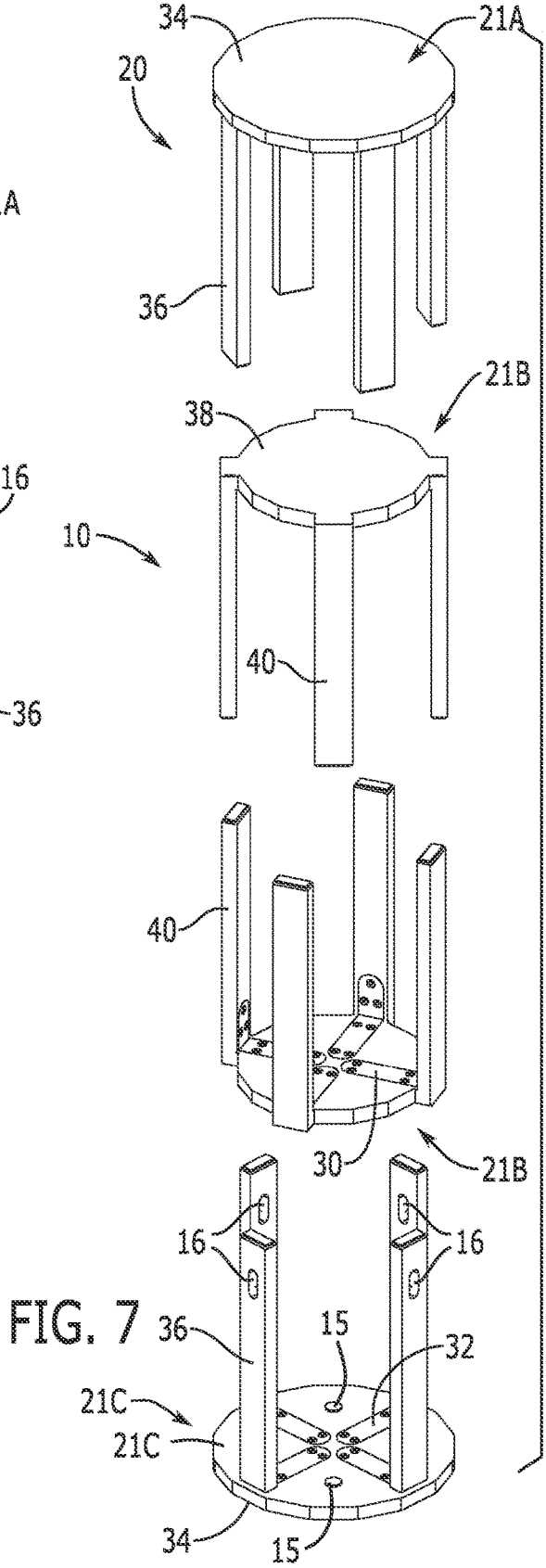
FIG. 7 is an exploded perspective view of one embodiment of the present disclosure.

Rather, as shown in FIGS. 6 and 7 an alternate top most stool 21A and bottom most stool 21C may each have a polygonal shaped outer platform with a plurality of outer stool legs 36 extending downward therefrom, wherein the outer stool legs 36 may have, for example, a substantially rectangular cross-section. Similarly, the middle stools 21B may each have a polygonal middle stool platform 38 with middle stool legs 40 extending downward from an outer circumference thereof. Thus, the middle stool platform 38 may be polygonal with rectangular protrusions extending outward therefrom, wherein the rectangular protrusions define a top edge of the middle stool legs 40. In yet further embodiments, the legs may have any desired cross section and the shape of the protrusions may vary. However, even with the difference in shape, the stools may stack in the same way, wherein the middle stools may nest between the top post stool 21A and the bottom most stool 20B to form an alternate stacked configuration 20 having a polygonal cross section.

While the Figures show that each of the stools may have four legs, the stools are not limited to only including for legs. Rather, the number of legs and the positioning of the legs on each platform may be varied, so long as an enclosed table is created when the stools are stacked together. Moreover, while the Figures show a version with the circular platform and with the polygonal platform, the stools are not limited to having such shape. Rather, the platforms can have any desired shape, so long as they nest together to form the enclosed table. Furthermore, while the drawings illustrate an embodiment with four total stools, wherein two of the stools are middle stools, it is envisioned that additional middle stools may be nested within the outer stools.

The stools of the present disclosure may be made from any suitable materials and, in some embodiments, comprise a wood, metal, or plastic material.

Because of how the stools nest together, the nested stools allow for concealed storage of extra seating, which may be particularly advantageous for small spaces and apartment living. In fact, the stools stack together to look like a single piece of functional furniture, rather than a stack of stools, thus removing the need for separate storage.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A piece of furniture that includes a plurality of stools that stack/nest into an enclosed table, the piece of furniture comprising:

a top most stool comprising a top platform and a plurality of top legs extending downward from a bottom surface of the top platform proximate to an outer edge of the top platform;

a first middle stool comprising a first middle platform and a first plurality of middle legs extending downward from an outer circumference of the first middle platform;

a second middle stool comprising a second middle platform and a second plurality of middle legs extending downward from an outer circumference of the second middle platform; and a bottom most stool comprising a bottom platform and a plurality of bottom legs extending downward from a bottom surface of the bottom platform proximate to an outer edge of the bottom platform, wherein:

the first middle stool and the second middle stool are configured to be nested within the top stool and the bottom stool when the bottom stool is inverted;

a top surface of each of the plurality of top legs is co-planar with the bottom surface of the top platform;

a top surface of each of the first plurality of middle legs is co-planar with a top surface of the first middle platform;

a top surface of each of the second plurality of middle legs is co-planar with a top surface of the second middle platform;

a top surface of each of the plurality of bottom legs is co-planar with the bottom surface of the bottom platform; and the plurality of top legs, the plurality of bottom legs, the plurality of first middle legs, and the plurality of second middle legs all have a same length.

2. The piece of furniture of claim 1, wherein:

the top most stool and the bottom most stool are identical in structure; and the first middle stool and the second middle stool are identical in structure.

3. The piece of furniture of claim 1, wherein:

the top platform and the bottom platform are both circular; and the first middle platform and the second middle platform are both circular with rounded protrusions extending from an outer circumference thereof, wherein the rounded protrusions define a respective top edge of each of the first plurality of middle legs and the second plurality of middle legs.

4. The piece of furniture of claim 1, wherein:

the top platform and the bottom platform are both polygonal; and the first middle platform and the second middle platform are both polygonal with rectangular protrusions extending from an outer circumference thereof, wherein the rectangular protrusions define a respective top edge of each of the first plurality of middle legs and the second plurality of middle leg.

5. The piece of furniture of claim 1, wherein:

the top most stool and the bottom most stool have a same height;

the first middle stool and the second middle stool have a same height; and the height of the first middle stool and the second middle stool is less than the height of the top most stool and the bottom most stool.

6. The piece of furniture of claim 5, wherein:

each of the top platform, the bottom platform, the first middle platform, and the second middle platform have a platform height;

a difference in height between the first stool and the middle stool and the top most stool and the bottom most stool is equal to the platform height.

7. The piece of furniture of claim 1, further comprising at least one orifice extending through at least one member selected from the group consisting of the plurality of top legs, the plurality of bottom legs, the plurality of first middle legs, and the plurality of second middle legs.

8. The piece of furniture of claim 1, wherein:

the plurality of top legs comprises four top legs;

the plurality of bottom legs comprises four bottom legs;

the plurality of first middle legs comprises four first middle legs; and the plurality of second middle legs comprises four second middle legs.

9. The piece of furniture of claim 1, wherein:

each of the first middle platform, the second middle platform, the top platform, and the bottom platform are circular; and a diameter of the first middle platform and a diameter of the second middle platform are each smaller than a diameter of the top platform and a diameter of the bottom platform.

* * * * *